United States Patent [19]

Snyder

[11] 4,079,534

[45] Mar. 21, 1978

[54] SIGHTING APPARATUS FOR FIREARMS

[76] Inventor: Wesley L. Snyder, 8709 Robindell, Houston, Tex. 77036

[21] Appl. No.: 717,349

[22] Filed: Aug. 24, 1976

[51] Int. Cl.[2] ..... F41G 1/36

[52] U.S. Cl. ..... 42/1 A; 362/110

[58] Field of Search ..... 33/247, 248, 249, 250; 42/1 A, 1 ST; 240/2 F, 6.41

[56] References Cited

U.S. PATENT DOCUMENTS

| | | | |
|---|---|---|---|
| 873,591 | 12/1907 | Penfield | 240/6.41 |
| 1,107,040 | 8/1914 | Conde | 240/6.41 |
| 1,452,651 | 4/1923 | Norrlin | 240/6.41 |
| 1,535,459 | 4/1925 | Fredrickson | 42/1 A |
| 3,867,764 | 2/1975 | Dunmire et al. | 42/1A |

FOREIGN PATENT DOCUMENTS

| | | | |
|---|---|---|---|
| 492,773 | 7/1919 | France | 33/247 |

OTHER PUBLICATIONS

Clair Rees, Guns, "The American 180–New .22 SMG," Dec. 1973, pp. 45–47.

William F. Krentz, The American Rifleman, "Scope Your Handgun for Higher Scores," June 1974, pp. 34, 35.

*Primary Examiner*—Stephen C. Bentley

[57] ABSTRACT

Sighting apparatus for attachment to a conventional firearm having a laser for projecting a beam of light onto a target to assist in aiming the firearm. The sighting apparatus permits the laser to be releasably attached to the firearm by providing a shockproof mount which carries the laser and is releasably attachable to an adapter secured to the firearm. To facilitate activation of the laser and yet avoid complications when removing the laser and mount from the adapter, the shockproof mount is provided with a switch mechanism that is activated by a trigger mechanism on the adapter. The sighting apparatus further permits substitution of interchangeable mounts, each carrying a laser, by providing an adapter which has a boresight adjustment mechanism that serves to adjust the position of the laser with respect to the barrel of the firearm. The laser is protected from damage by the shockproof mount which comprises a pneumatic buffer that absorbs recoil energy.

9 Claims, 13 Drawing Figures

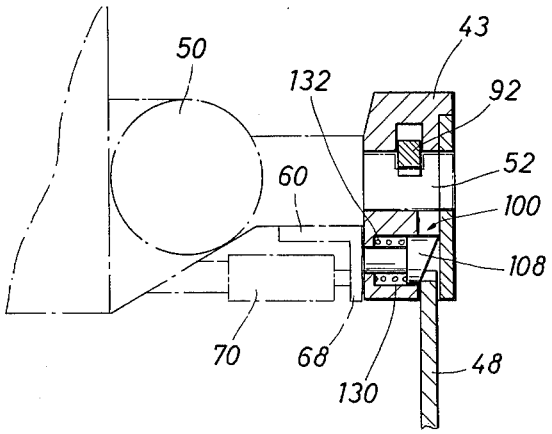
FIG.7
FIG. 8
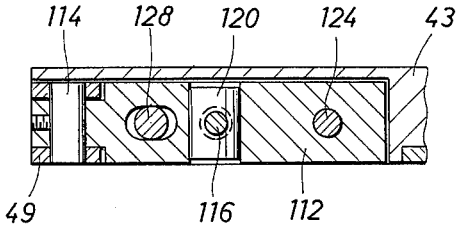
FIG. 9
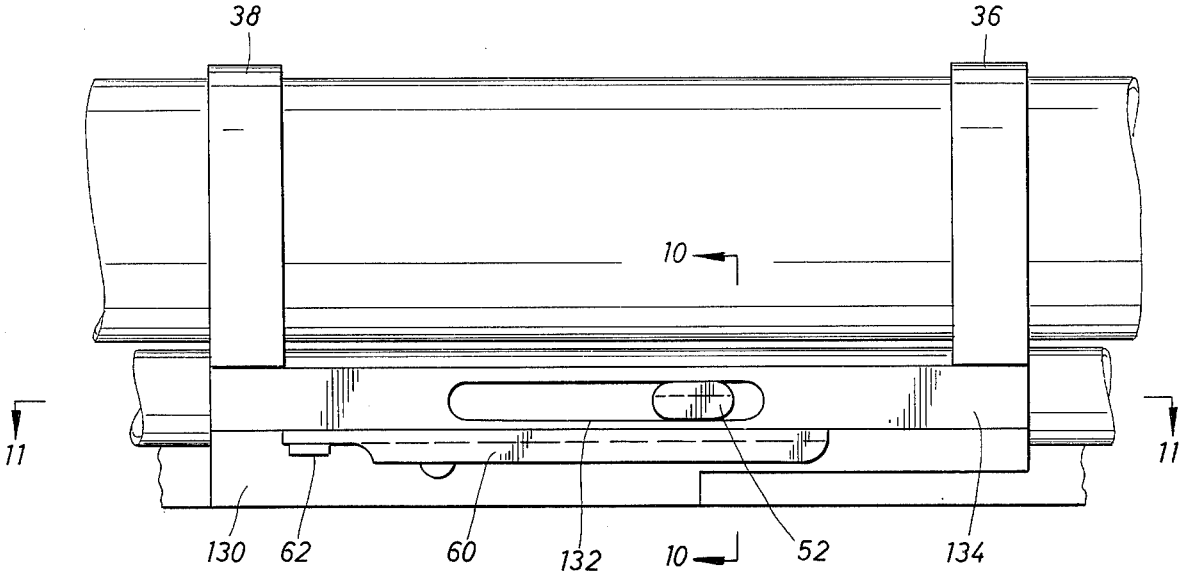
FIG. 10
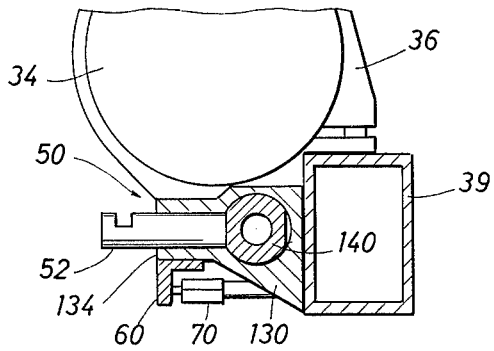

SIGHTING APPARATUS FOR FIREARMS

BACKGROUND OF THE INVENTION

1. Field of the Invention

This invention relates generally to sighting apparatus for attachment to a firearm, and more particularly to sighting apparatus having a light projection aiming device, and which is releasably attached to the firearm permitting rapid attachment and detachment thereof.

It is well known in the art to attach a light projection device, particularly a laser, to a firearm to assist in aiming the firearm at a target. The advantages provided by a laser-sighted firearm, especially at night, are acknowledged. For police and law enforcement personnel, the need for accurate aiming of their firearms to prevent injury to innocent bystanders is acute; and pursuing officers will sometimes withold firing at a fleeing suspect for this reason. The ability to pin-point the position where a bullet will strike if fired from a firearm obviates much of the concern for inadvertent shootings.

The need for laser-sighted aiming is not always present; and in close quarters in daylight, the laser aiming device with its attendant bulk and weight can be a hindrance rather than a help. Therefore, it is desirable to provide sighting apparatus having a mounting adapter that permits a laser aiming device to be placed on or removed from a firearm very quickly and easily. Also, in case failure of one laser aiming device occurs, it is desirable to have a mounting adapter that permits substitution of aiming devices without re-sighting of the aiming device with respect to the barrel of the firearm.

An additional problem associated with laser-sighted firearms is the possibility that the laser will be accidentally activated, permitting a beam of potentially hazardous and damaging strength to be released. Great damage to the human eye may result from impingement thereon of a beam of laser light. Accordingly, it is desirable to have a safety mechanism to prevent accidents from occurring through the inadvertent activation of a laser aiming device.

A further problem with a laser-sighted firearm is that the laser tube may be damaged during firing because of the recoil of the firearm. Therefore, it is desirable to provide sighting apparatus with a shockproof mount to absorb recoil energy. The recoil energy absorbing mechanism must not, however, present be cumbersome or add excessively to the weight of the sighting apparatus.

Finally, it is desirable to have a conveniently operable mechanism for activating the laser to project a beam onto the target when the marksman is ready to fire a round. An inconvenient activation mechanism or one that is cumbersome to manipulate would greatly impair the effectiveness of a laser-sighted firearm, especially during rapid fire situations. Providing an effective activation mechanism becomes even more of a problem where the laser is to be releasably mounted to the firearm.

2. Description of the Prior Art

One approach to providing a laser-sighted weapon in which the aiming light portion is removable in U.S. Pat. No. 3,867,764 issued to Dunmire et al. This patent discloses an aiming light attached by a molded portion to an aiming light adapter which mounts on a weapon adapter. The weapon adapter is designed to fit in the handle of a weapon and is attached to the weapon before the aiming light adapter is mounted thereon. The weapon adapter includes a tongue portion which engages a groove portion on the aiming light adapter. The aiming light adapter includes horizontal and vertical adjusting mechanisms for positioning the aiming light beam with respect to the bore alignment of the weapon.

Dunmire et al., while providing sighting apparatus that is releasable to permit placement on or removal from a firearm, does not provide a shockproof mount, but instead, solidly mounts the aiming light to the firearm. The major drawback of Dunmire, however, is that horizontal and vertical alignment devices do not permit aiming lights to be interchanged without subsequent sighting-in of the aiming light with the barrel of the firearm.

Another sighting apparatus for attachment to a firearm is that disclosed in U.S. Pat. No. 2,844,710, issued to Zinsser. This patent discloses a light projector adapted to be supported on the barrel of a weapon by a clamp that is adjustable to set the axis of the projector to project a beam of light onto a point on the trajectory of a bullet fired from the firearm. The projector is activated by electrical current supplied through a switch contact that is disposed away from, but in close proximity to, the finger grip of the firearm trigger. Contact between the switch contact and the trigger of the firearm will complete an electric circuit to the projector permitting the lamp therein to be turned on. Zinsser provides an activation mechanism that is convenient to operate by the marksman; however, the mechanism disclosed is not, because of the necessity of interconnecting wires, compatible with a quick release sighting mechanism.

Key, U.S. Pat. No. 1,826,004, discloses sighting apparatus having a light projection device for aiming and a mount for temporarily attaching the light projection device to the firearm in such a way that the recoil of the firearm places no shock on the device. The approach taken to absorb recoil energy is that of pivoting the firearm to the sighting apparatus so that upon firing the firearm will recoil away from or separate from the sighting apparatus.

Although the prior art discloses sighting apparatus having mounting adapters for attaching a laser or other similar types of light emitting sources to a firearm, there is not provided sighting apparatus which permits quick and ready removal of the aiming device from the firearm, and which has the additional desired features of interchangeability of aiming devices without requiring that the aiming device be re-sighted in with respect to the barrel of the weapon and without requiring the reconnection of wiring between the aiming device and an activating switch.

SUMMARY OF THE INVENTION

In accordance with the instant invention, there is provided sighting apparatus for attachment to a firearm having a light emitting device for projecting a beam of light onto a target to assist in aiming the firearm at the target. The instant invention provides sighting apparatus that permits the laser aiming device to be releasable from the firearm for temporary usage, and which permits substitution of interchangeable aiming devices without re-sighting of the aiming device with respect to the barrel of the firearm. The instant invention also provides sighting apparatus having a mechanism for activating the light emitting device, which mechanism does not require inconnecting wiring that must be connected and reconnected.

The instant invention further provides sighting apparatus that includes a shockproof mount which absorbs recoil energy developed upon firing of the weapon. The shockproof mount functions to prevent damage to the light emitting device (i.e., a laser emission device).

Finally, there is provided a laser safety head mechanism which is adapted to fit over the opening of a laser tube to block laser emissions therefrom. The safety head is operable to open and close, in shutter-like fashion, the opening from which a laser beam is released.

In accordance with this invention and to achieve the above features, there is provided sighting apparatus comprising a shockproof mount to which a light emitting device attaches. The mount includes a mounting arm and a switch mechanism for activating the light emitting device to project a beam of light onto a target. An adapter is secured to the firearm for releasably attaching the shockproof mount to the firearm. The adapter includes a latch mechanism for engaging the arm on the shockproof mount, a bore sight adjustment mechanism that provides horizontal and vertical adjustment of the light emitting device with respect to the barrel of the firearm, and a trigger mechanism that is disposed adjacent the finger grip of the firearm with an actuator member that operates the switch mechanism on the shockproof mount.

To provide sighting apparatus wherein the light emitting device is releasable from the firearm, the adapter is provided with a slotted aperture that receives the arm on the shockproof mount. The latch mechanism in the adapter engages the arm with a spring loaded pawl. The spring loaded pawl is mounted for movement within the adapter, with means being provided for moving the pawl from a first position wherein the pawl engages the arm to a second position wherein the pawl is desengaged from the arm permitting its removal from the adapter.

In order to permit interchangeable light emitting devices to be substituted onto the firearm without a subsequent re-sighting of the light emitting device, the boresight adjustment mechanism is made integral with the adapter that attaches to the firearm. To accomplish this feature, the adapter includes a piece pivotally mounted to handle portion for movement in a vertical plane and an adapter body portion pivotally mounted to the piece for movement in a horizontal plane. To provide elevation adjustment of the light emitting device, the bore sight adjustment mechanism comprises a threaded member that extends between the handle portion and the pivoted piece to engage mating threads in a rotatable member carried in the piece. The threaded member is operable to pivot the piece about the handle portion as the threaded member is turned within the threads in the rotatable member. To effect horizontal adjustment of the light emitting device, a cam having an off-set portion that engages a slot formed in the pivoted piece is carried in the adapter body portion. The cam is operable to pivot the adapter body portion with respect to the handle portion as the cam is rotated, thereby altering the horizontal disposition of the light emitting device with respect to the barrel of the firearm.

The trigger mechanism included in the present invention comprises a finger grip pivotally mounted on the adapter so arranged as to be disposed adjacent the finger grip on the firearm, and an actuator member carried in the adapter for reciprocating movement with resilient means biasing the actuator member against the finger grip. The actuator member is moved against the resistance of the resilient means through camming action which occurs between the finger grip and the actuator member as the finger grip is pivoted. The actuator member on the adapter is positioned to align with the switch mechanism on the shockproof mount, which mechanism comprises a pivoted bar and a push rod that bears against the bar at one end and operable from the other end to close the contacts of a switch that are in the electrical circuit path that supplies current to the light emitting device. The actuator member of the trigger mechanism bears against the pivoted bar which the shockproof mount in attached to the adapter such that, and upon movement of the finger grip, the actuator member moves the bar, thereby effecting opening or closing of the switch contacts.

The shockproof mount which is provided to prevent damage to the light emitting device includes a pneumatic buffer that is operable to absorb the recoil energy of the firearm. The pneumatic buffer comprises a cylinder having an orfice at each end with a piston being disposed in the cylinder for longitudinal movement therein. The piston has the mounting arm which is engaged by the latching mechanism of the adapter secured to it. First and second resilient means are disposed within the cylinder on opposite sides of the piston, with the opposite ends of each resilient means disposed bearing against an end of the cylinder and an end of the piston.

The laser safety head which is adapted to fit over the opening of the light emitting device (laser) to block light emission therefrom comprises a head adapter for disposition on the end of the device from which emissions are released. The adapter includes a port arranged to be aligned with the opening in the light emitting device, with a channel recess formed about the port. A shutter slidable within the recess and held in place by a retaining bar is engaged by a rotary member mounted for rotation on the head adapter. The rotary member is operable to move the shutter within the recess to cover or uncover the port. A detent carried by the head adapter engages the rotary member to lock the shutter into position.

This invention, although especially suitable for use with a pistol type firearm is also useful with other types of firearms such as rifles and shotguns. Other aspects of this invention not outlined above will be disclosed from the detailed description presented below.

BRIEF DESCRIPTION OF THE DRAWINGS

A more complete appreciation of the invention may be had by reference to the accompanying drawings, illustrating a preferred embodiment of the invention to be described in detail, in which like reference numerals designate identical or corresponding parts throughout the several views and wherein:

FIG. 7 is a sectioned frontal view of the latch mechanism and trigger mechanism carried in the adapter illustrated in FIG. 6;

FIG. 8 is a sectioned plan view of the boresight adjustment mechanism carried in the adapter;

FIG. 9 is a side view of the shockproof mount that holds the light emitting device;

FIG. 10 is a sectioned frontal view of the shockproof mount shown in FIG. 9;

DESCRIPTION OF A PREFERRED EMBODIMENT

Figure 2:
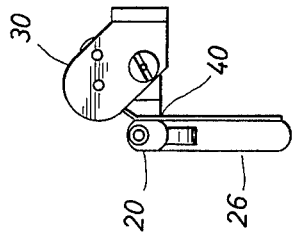
FIG. 2 is a frontal view of the firearm in FIG. 1 showing the sighting apparatus attached in position along side the firearm.
Figure 1:
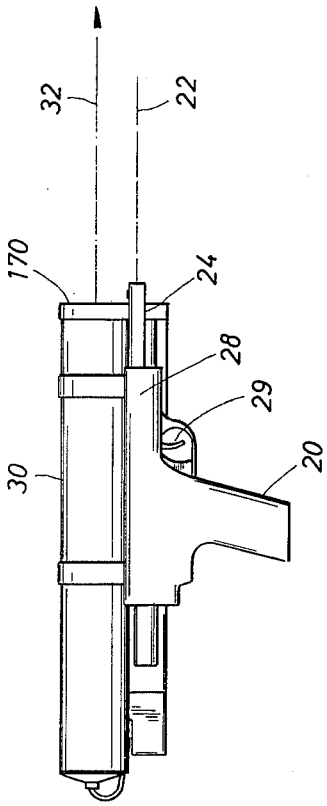
FIG. 1 is a side view of a firearm having sighting apparatus in accordance with the present invention attached thereon.

Referring now to the drawings, and more particularly to FIGS. 1 and 2 thereof, there is shown a firearm 20, an automatic pistol, having sighting apparatus 30 attached thereon. Sighting apparatus 30 projects a beam 32 of coherent light that is aligned to coincide at some distance with the bore axis 22 of barrel 24 of firearm 20. As will be appreciated, the present invention, one embodiment of which is shown in the various drawings, is adaptable for use with any type firearm such as a pistol, rifle, or shotgun; although, discussion of this embodiment will be principally with regard to its attachment to a pistol.

As shown in FIGS. 1 and 2, sighting apparatus 30 is disposed alongside firearm 20 and is releasably secured thereto by an adapter 40. Although adapter 40 is shown to be secured to firearm 20 on the pistol grip portion 26 thereof, the adapter may be configured to attach in any number of ways, including mounting to the body portion 28 of the firearm. However, it will be recognized that in order to facilitate handling of a weapon having sighting apparatus of the type disclosed mounted thereon, the adapter must place the center of gravity of the sighting apparatus as near as possible to the firearm in order to prevent difficulty in holding the firearm steady during aiming.

Figure 3:
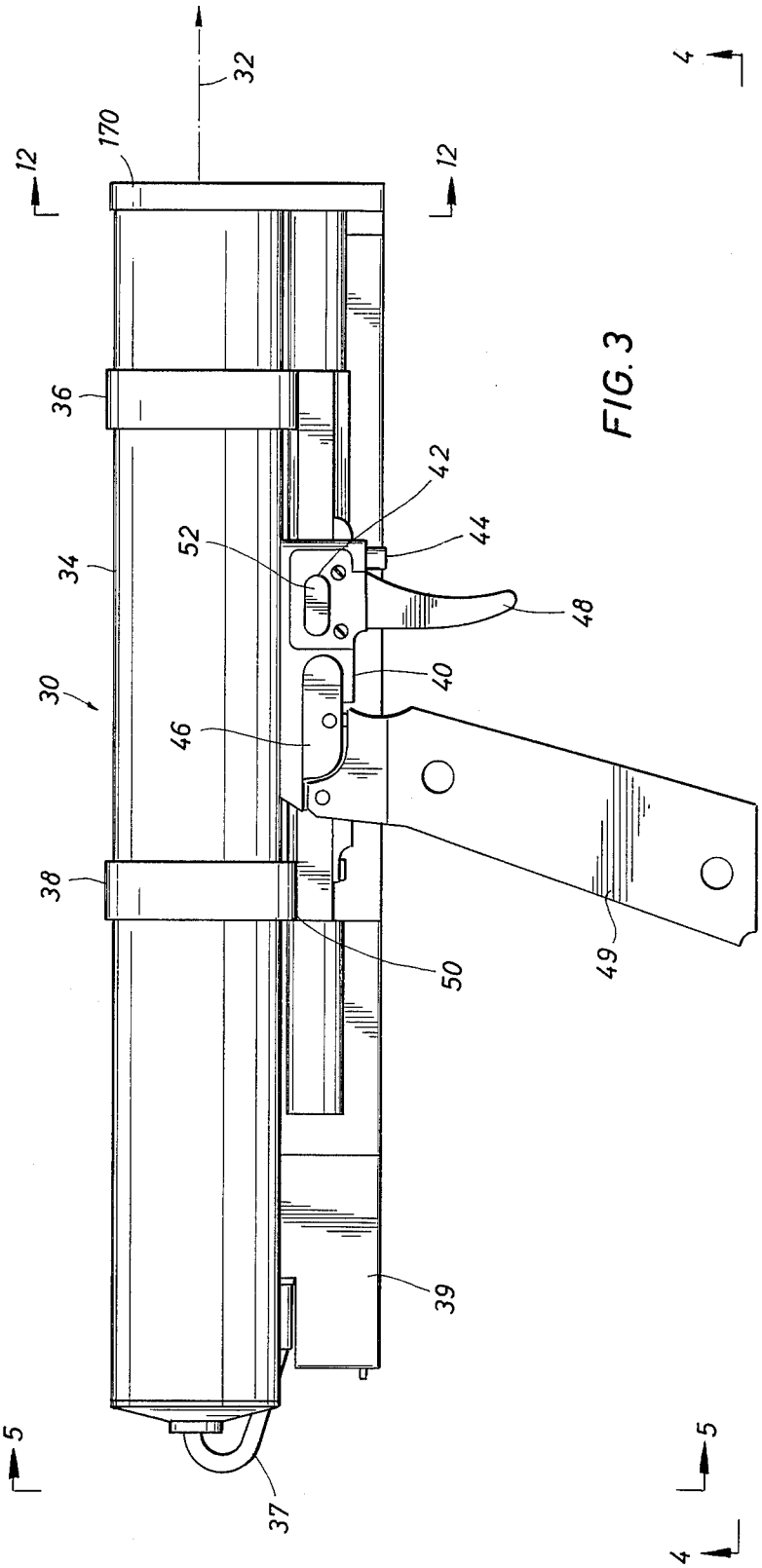
FIG. 3 is an enlarged side view of the embodiment of the sighting apparatus of the present invention illustrated in FIG. 1.

In FIG. 3, additional details of sighting apparatus 30 are presented, especially light emitting device 34 which may be, for example, a helium-neon laser. Light emitting device 34 is attached to a shockproof mount 50 by a pair of clamps 36, 38 which extend about the circumference of light emitting device 34 and are firmly secured to shockproof mount 50.

Light emitting device 34 projects a beam of light onto a target that is desired to be fired upon. The electrical power to light emitting device 34 is supplied via electrical conductors carried in a cable 37 that enters the rear of light emitting device 34. The power supply portion of sighting apparatus 30 is carried in a housing 39 that extends along and beneath light emitting device 34.

Also shown in FIG. 3 releasably attached to shockproof mount 50 is adapter 40. Specifically, adapter 40 attaches to shockproof mount 50 by an arm 52 that extends from shockproof mount 50 and is received into an aperture 42 in adapter 40. A latch mechanism (not shown) formed in adapter 40 engages the arm 52. The latch mechanism is releasable by depressing the release button 44.

Adapter 40 further includes bore sight adjustment mechanism 46 which provides horizontal and vertical adjustment of the light emitting device 34 with respect to the barrel of the firearm. Also, a trigger mechanism (not shown) having a finger grip 48 disposed adjacent the finger grip 29 of firearm 20 is provided. The trigger mechanism operates a switch on the shockproof mount which is in the electrical circuit path of current flowing to the light emitting device 34.

The handle portion 49 of adapter 40 is in this embodiment, of course, adapted for attachment to the handle of a pistol. However, it will be appreciated that a portion 49 could be configured in any shape desirable in order to effect securement of adapter 40 in any of a number of ways to firearm 20. For example, portion 49 could be configured in the shape of a clamp which would attach to the barrel of the firearm.

Figure 4:
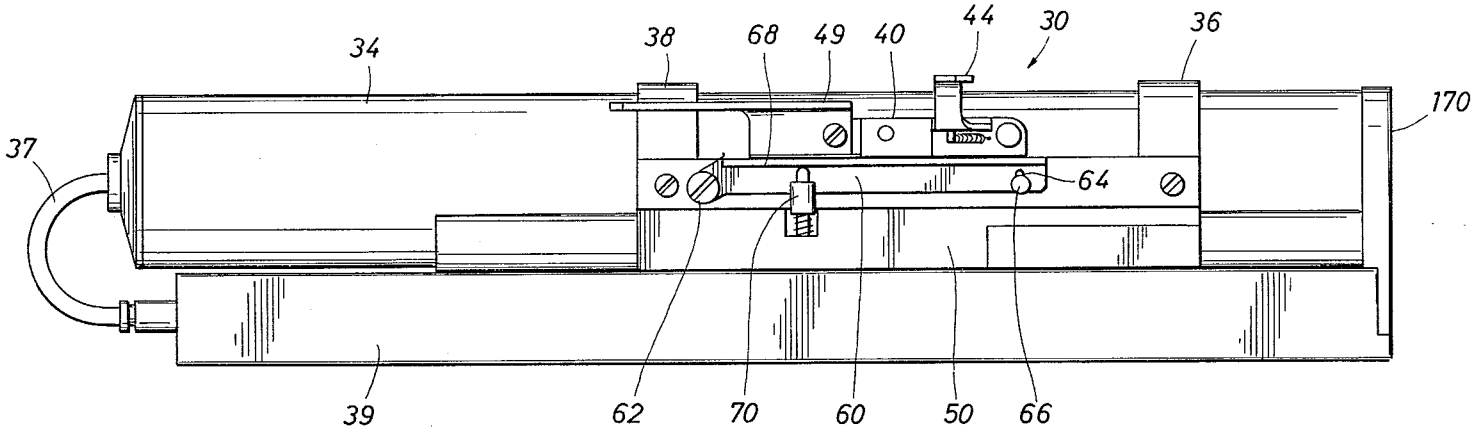
FIG. 4 is a view of the underside of the sighting apparatus shown in FIG. 3.

Referring next to FIG. 4, an underside view of sighting apparatus 30 is presented. Of particular interest in this view is the switch mechanism attached to shockproof mount 50 for activating the light emitting device 34. The switch mechanism includes an angular slide bar 60 pivotally mounted to the underside of shockproof mount 50 by a pivot screw 62. At the forward end of slide bar 60, a slotted opening 64 is provided having a stop pin 66 extending therethrough. The combination of stop pin 66 and slotted opening 64 limit the lateral movement of slide bar 60. An upwardly projecting wall portion 68 engages a spring loaded push rod 70 which in turn actuates electrical contacts that are in the circuit path between light emitting device 34 and the power supply. Slide bar 60 and thus the push rod 70 are operated by an actuator member that forms a component part of the trigger mechanism in adapter 40. Details of the trigger mechanism and its function in operating the switch mechanism on shockproof mount 50 will be given in the discussion of adapter 40, taken up in relation to the illustration of FIG. 7.

Figure 5:
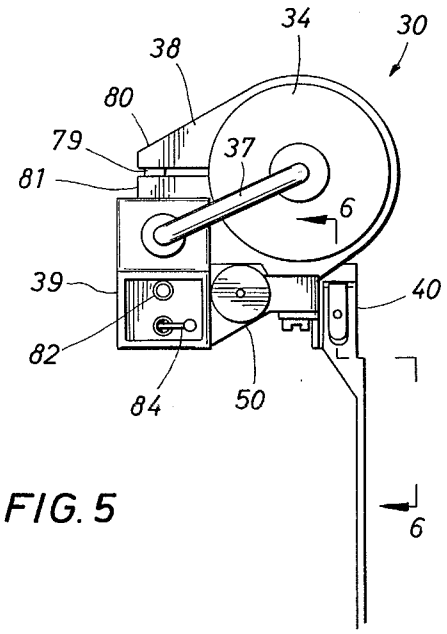
FIG. 5 is a rear view of the sighting apparatus.

Referring next to FIG. 5, a rear view of sighting apparatus 30 is provided in order to give additional details of that portion of the apparatus. Specifically, it will be observed that the clamps holding light emitting device 34, such as clamp 38, are split-ring clamps having a threaded member 79 which may be advanced in threads carried by the separate ends 80 and 81 of clamp 38 in order to bring those ends closer together and thus tighten around the outside of light emitting device 34.

Cable 36 is shown extending from power supply housing 39 to the rear of light emitting device 34. Power supply housing 38 carries in addition, an on-off indicator lamp 82 and an on-off master toggle switch 84. Shockproof mount 50 is also in view in FIG. 5, as is adapter 40 which is shown in attachment to shockproof mount 50.

Figure 6:
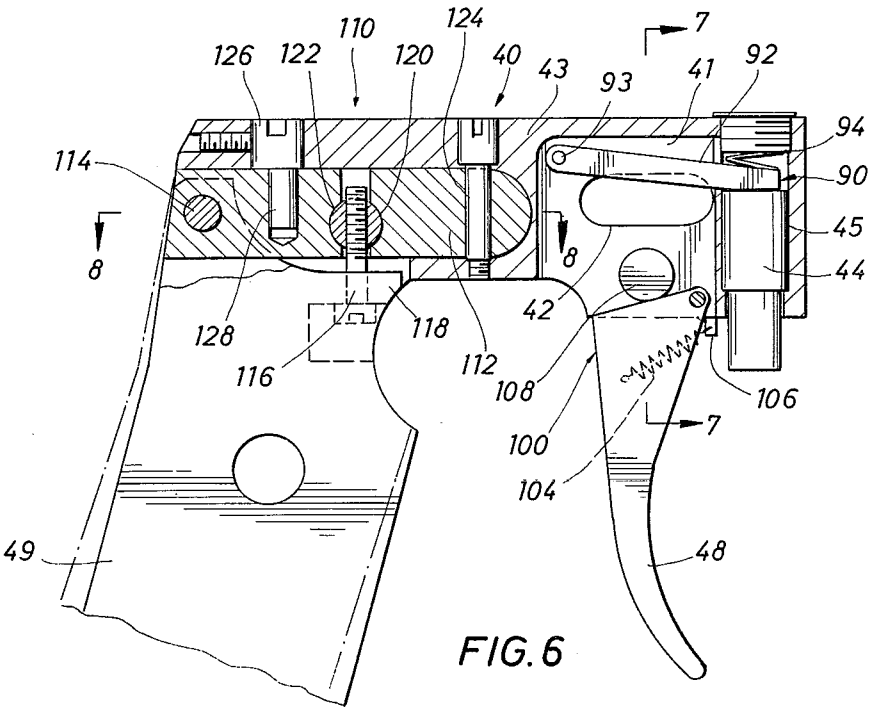
FIG. 6 is a view of the adapter portion of the sighting apparatus that mounts to the firearm and engages a shockproof mount holding a light emitting device in order to effect attachment to the firearm of the light emitting device.

Turning now to FIGS. 6, 7 and 8, attention will be given to specific details of adapter 40. FIG. 6 is a cutaway view of adapter 40, opening up to view the latch mechanism (generally denoted by reference numeral 90), the trigger mechanism (generally denoted by the reference numeral 100), and the bore sight adjustment mechanism (generally denoted by the reference numeral 110). More specific details of the trigger mechanism 100 will be given in the discussion presented with regard to FIG. 7; however, the primary features of the latch mechanism 90 and the bore sight mechanism 110 will be given in the discussion relating to FIG. 6.

The latch mechanism 90 shown in FIG. 6 is but one suitable latching mechanism for releasably securing the light emitting device 34 to a firearm. The latch mechanism 90 shown is built into the forward portion of the adapter 40 within a recessed portion 41 of adapter body 43. The latch mechanism 90 is disposed about the aperture 42 in adapter body 43 into which the arm 52 of shockproof mount 50 is insertable.

The latch mechanism 90 includes a spring loaded pawl 92 pivotally mounted within recess 41 to adapter body 43 by a pin 93 that is disposed above and adjacent the aperture 42. Spring 94 urges pawl 92 downwardly such that it will assume a position wherein its lower edge will be at a level beneath the upper edge of aperture 42. Pawl 92 is retractable to a location wherein it is not disposed over aperture 42 by a push-button 44 that is movable within a sleeve portion 45 that is formed within adapter body 43.

As mentioned previously, latch mechanism 90 provides a quick release means of attaching light emitting device 34 to a firearm. In operation, when it is desired to affix the light emitting device to a firearm to which adapter 40 is mounted, push-button 44 is depressed against the force of spring 94. This causes pawl 92 to be pivoted about pin 93 raising it above and from in front of aperture 42. The arm 52 on shockproof mount 50 may then be inserted into aperture 42. Upon release of push-button 44, spring 94 urges pawl 92 downwardly and into engagement with a groove that is formed (see FIG. 7) in arm 52. In the latched position, latch mechanism 90 firmly holds the light emitting device in relation to the firearm. When it is desired to remove the light emitting device, push-button 44 is depressed raising pawl 92 and disengaging it from the notch in arm 52, thereby releasing arm 52 and permitting its withdrawal from aperture 42.

With continuing reference to FIG. 6 and also to FIG. 8, the bore sight adjustment mechanism which provides horizontal and vertical adjustment of the light emitting device with respect to the barrel of the firearm includes a piece 112 that is pivoted to handle portion 49 about an axis pin 114 for movement in the vertical plane of the adapter. Piece 112 is insertable for a close, though not binding, fit into adapter body portion 43. Elevation adjustment for adapter 40 is provided by adjusting the attitude of piece 112 about the pivot axis pin 114. Elevation adjustment is by a screw 116 that is inserted through a lip 118 on handle portion 49, and which engages threads in a drilled and tapped hole within a cylindrical pin 120 that is rotatable in a race 122 formed in the piece 112.

To adjust the elevation of the light emitting device with respect to the barrel of the firearm, screw 116 is turned either clockwise or counter-clockwise depending upon whether it is desired to lower or raise the elevation. If the elevation is to be lowered, that is the beam of the light emitting device is to be lowered, screw 116 is turned clockwise advancing it further into the threads of cylinder 120 causing piece 112 to be turned about axis pin 114. It will be appreciated that as piece 112 turns about axis pin 114 that body portion 43 which is fixed relative to piece 112 will be moved with respect to handle portion 49 which is, of course, securely affixed to the firearm. Inasmuch as the light emitting device is securely fixed relative to the adapter body portion 43 by virtue of being securely engaged by latch mechanism 90, the light emitting device will also be moved relative to the handle portion 49, and thus relative to the firearm.

Horizontal adjustment of the light emitting device is achieved by providing adapter body portion 43 with lateral movement relative to piece 112 which is prevented from moving laterally by axis pin 114. Specifically, adapter body portion 43 is pivoted on piece 112 by a pivot pin 124 carried in the forward portion of piece 112. Pivot pin 124 has a shank portion that passes through the end of piece 112 and a threaded portion beneath the shank which screws into threads in a portion of adapter body 43 that lies beneath piece 112. A cam pin 126 having an off-set protuberance 128 is carried in adapter body portion 43 with the protuberance 128 extending into a slot formed in piece 112. To adjust the horizontal positioning of the light emitting device with respect the weapon, cam pin 126 is rotated which causes the offset protuberance 128, which is restricted from moving by the slot in piece 112, causes adapter body portion 43 to pivot about pin 124. This movement about pin 124 causes the frontal portion of adapter body 43 which carries latch mechanism 90 to move laterally with respect to the barrel of the firearm.

Referring now to FIG. 6 in conjunction with FIG. 7, the arrangement of trigger mechanism 100 which operates an electrical contact switch on the shockproof mount 50 will be described. As is shown in FIG. 6, the trigger mechanism includes a finger grip 48 that is pivotally attached to the adapter body 43 within the recess 41 by a pin 102. The finger grip 48 is biased by a spring 104 that connects between the finger grip and a tab 106 on adapter body portion 43. The uppermost portion of finger grip 48 bears against an actuator member 108 that is disposed within a cylindrical bore formed in adapter body portion 43 and beneath aperture 42.

As can be more adequately viewed in FIG. 7, actuator member 108 has a slanted surface which the upper portion of finger grip 48 bears against. As finger grip 48 is rotated about pin 102 against the resisting force of spring 104, actuator member 108 is moved laterally within the bore 130 against the resisting force of a spring 132 by a camming action. Actuator member 108 is disposed for alignment with angular slide bar 60, particularly the wall portion 68 thereof. As previously discussed in regard to FIG. 4, bar 60 is pivoted for lateral movement and bears against a spring loaded push rod 70 which further actuates electrical contacts that control the supply of electrical current to the light emitting device 34. Thus when it is desired to activate the light emitting device 34 to project a beam of coherent light onto a target that is desired to be fired upon, movement of finger grip 48 of trigger mechanism 100 will cause actuator member 108 to be urged against bar 60 which further engages pin 70 closing the switch contacts that supply current to the light emitting device.

Also in view in FIG. 7 is a portion of latch mechanism 90, particularly pawl 92 which engages the arm 52 on shockproof mount 50. As will be seen from the drawing in FIG. 7, pawl 92 engages a notch on the upperside of arm 52.

Figure 11:
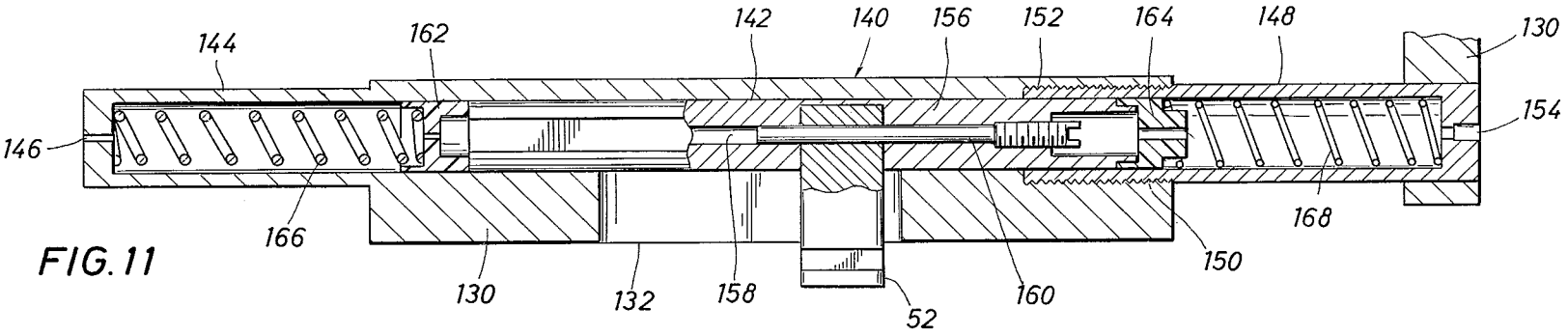
FIG. 11 is a cross sectional view of a buffer mechanism for the shockproof mount, particularly illustrating the internal components of the buffer.

Details of the shockproof mount 50 are presented in FIGS. 9–11, with FIGS. 9 and 10 in particular illustrating the base portion 130 which carries clamps 36 and 38. As best seen in FIG. 10, base portion 130 attaches to the power supply housing 39 and extends outwardly therefrom with the underside of the base portion 130 tapering upwardly. The switch mechanism actuated by trigger mechanism 100 to open and close the electrical contacts that supply electrical power to the light emitting device 34 is mounted as shown on the underside of base portion 130.

Mounting arm 52 is shown in FIG. 9 disposed in a slot 132 formed in a ledge 134 to which the switch mechanism is connected. As will be explained more fully in connection with FIG. 11, mounting arm 52 is connected to pneumatic buffer 140 carried in base portion 130. Mounting arm 52, though rigidly affixed to the firearm 20, is moveable via buffer mechanism 140 relative to light emitting device 34. This movement is of course defined along the guide path provided by slot 132. Since slot 132 extends substantially parallel to the firearm to which shockproof mount 50 is connected, movement of light emitting device 34 with respect to the firearm will be along a line that is substantially parallel to the barrel of the firearm.

Turning now to FIG. 11, the internal components of buffer 140 are shown in the cross sectional view presented. As will be apparent, buffer mechanism 140 is formed in the base portion 130 of shockproof mount 50. Specifically, a central portion 142 intermediate the ends of the buffer mechanism is formed in base portion 130. Formed integrally with this intermediate portion is an aft portion 144, which aft portion has an orifice 146 centrally disposed in the end providing communication between the outside and the inside of portion 144. A forward portion 148 is of a similar configuration to the aft portion 144, except that the forward portion 148 carries threads 150 which engage mating threads 152 that are cut in body portion 130. An orifice 154 is also present in the forward portion 148 to permit communication between the outside and the inside. Together, portions 142, 144 and 148 comprise a cylinder 149.

An elongate piston 156 is disposed within cylinder 149 for longitudinal movement therein. Piston 156 has an internal bore 158 that extends throughout its entire length and into which a retaining rod 160 is fitted. As shown, mounting arm 52 disposed within slot 132 is secured to piston 156 and held thereto by retaining rod 160. Thus, force applied to mounting arm 52 will be transmitted to piston 156.

Each end of piston 156 has an end cap 162, 164 with a centrally disposed orifice that is in communication with the internal bore 158 in piston 156. First and second resilient means 166, 168 are disposed within cylinder 149 on opposite sides of piston 156 with the opposite ends of each resilient means in engagement with an end cap 162, 164 on piston 156 and an end of the fore and aft portions 144, 148.

As the firearm 20 shown in FIG. 1 is fired, recoil forces that are developed will be applied to mounting arm 52 on shockproof mount 50. The force will be transmitted to piston 156 via the connection of mounting arm 52 to piston 156. Mounting arm 52 and piston 156 will be urged rearwardly with respect to base portion 130 of shockproof mount 50, with mounting arm 52 traveling in slot 132 and piston 156 traveling within the bore of cylinder 149. Piston 156 will be urged against the resilient means 166, which is shown as a coil spring, and also against the volume of air contained within aft portion 144 of cylinder 149. Movement of piston 156 in this direction will compress not only resilient means 166, but the air within aft portion 144 also. As the air within aft portion 144 is compressed, some air will be released through orifice opening 146, and a smaller amount will be urged into the bore 158 in piston 156. As the piston is moving in this direction within cylinder 149, a slight vacuum is created in the internal volume of forward portion 148 of the cylinder. When the recoil force has been dissipated through the compression of resilient means 166 and the air contained within the aft portion 144, resilient means 166 in conjunction with the pressure differential across piston 156 urge the piston toward the forward end of cylinder 149 and back to its initial position.

Figure 13:
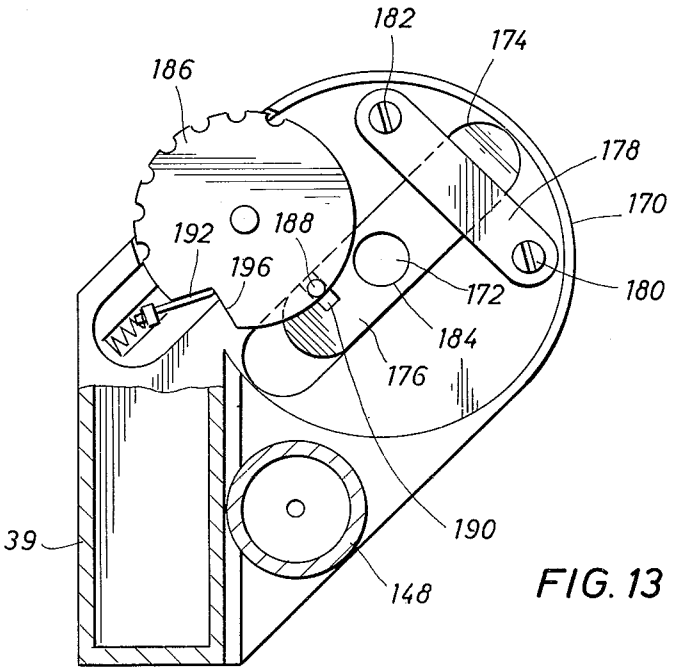
FIG. 13 is a view similar to that of FIG. 12 except that the device is shown in the open position.
Figure 12:
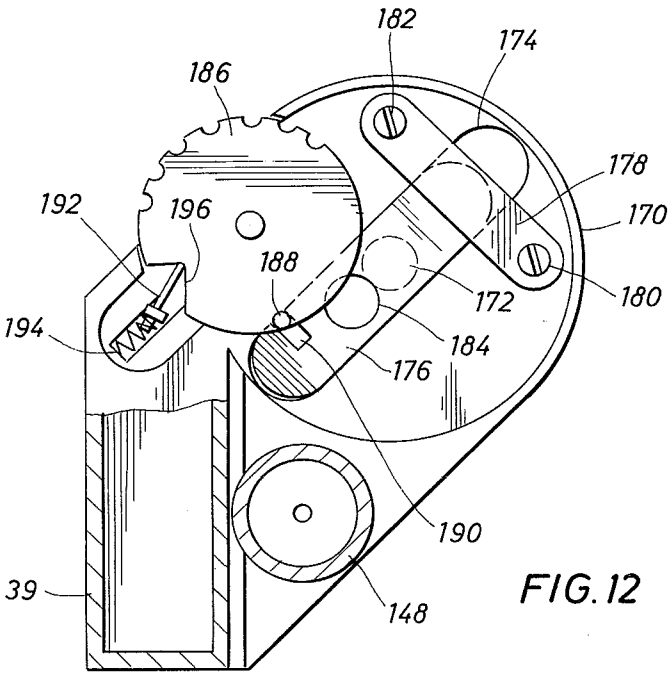
FIG. 12 is a view of a safety head attachment for the light emitting device used in the sighting apparatus, showing the closed position.

Referring now to FIGS. 12 and 13, a novel safety head mechanism for attachment to a laser emission device is presented. The embodiment of the laser safety head of the instant invention includes a head adapter 170 for disposition on the end of a laser tube from which laser emissions are released. The adapter has a port 172 arranged to be aligned with the opening in the laser tube from which emissions are released. Head adapter 170 further includes elongate channel recess 174 formed about port 172. A shutter 176 is slidable within recess 174 and is held in place by a retaining bar 178, which is oriented transversely to recess 174 and held in position by screws 180 and 182. Shutter 176 includes an opening 184 formed in shutter 176 that is registerable with port 172.

A rotary member, such as thumbwheel 186, is mounted for rotation on head adapter 170 and operably engages shutter 176 by a driving pin 188 that engages a notch 190 in shutter 176. Upon rotation of thumbwheel 186, shutter 176 is moved in channel recess 174 between positions wherein opening 184 is in registration with port 172 and wherein shutter 176 blocks passage of light through port 172.

A spring loaded detent 192 is disposed in a channel 194 within a portion of head adapter 170. Detent 192 engages a notch 196 formed in thumbwheel 186 and serves to lock the mechanism into one of the two positions defined above.

FIG. 12 illustrates the "closed" position of the laser safety head wherein shutter 176 covers port 172, thereby blocking any laser emissions should the laser device be accidentally turned on prior to usage. FIG. 12, on the other hand, illustrates the position wherein shutter 176 is moved into a position wherein opening 184 and port 172 are in registration. When moved between either of the two illustrated positions, shutter 176 is held in place by detent 192.

The foregoing description of the instant invention has been directed to a particular preferred embodiment of the present invention for purposes of explanation and illustration. It will be apparent, however, to those skilled in this art that many modifications and changes in the apparatus may be made without departing from the scope and spirit of the invention. It is therefore intended that the following claims cover all equivalent modifications and variations as fall within the scope of the invention as defined by the claims.

What is claimed is:

1. Sighting apparatus for attachment to a firearm to assist in aiming the firearm at a target, comprising:

an interchangeable light emitting device for projecting a beam of light onto a target;

a shockproof mount to which said light emitting device rigidly attaches, said mount having a mounting arm and an integral switch mechanism for activating said light emitting device; and an adapter to be rigidly secured to the firearm and facilitating releasable attachment of said shockproof mount to the firearm, said adapter including a latch mechanism for engaging the arm on said mount, a boresight adjustment mechanism integrally formed with said adapter and providing horizontal and vertical adjustment of said shockproof mount with respect to the barrel of the firearm, and a trigger mechanism for disposition adjacent the finger grip of the firearm and having an actuator member that operates the switch mechanism on said shockproof mount.

2. The apparatus of claim 1 wherein said light emitting device is a helium-neon laser.

3. The apparatus of claim 1 wherein said adapter has a slotted aperture for receiving the arm on said mount therein, and said latch mechanism comprises:

a spring loaded pawl mounted for movement within said adapter and for engaging said arm; and means for moving said pawl from a first position wherein said pawl engages said arm to a second position wherein said pawl is disengaged from said arm.

4. The apparatus of claim 1 wherein said adapter includes a handle portion of a configuration that matches the hand grip portion of a firearm to which it is attached, a piece pivotally mounted to said handle portion for movement in a vertical plane, and an adapter body portion pivotally mounted to said piece for movement in a horizontal plane.

5. The apparatus of claim 4 wherein said boresight adjustment mechanism comprises:

a threaded member extending between said handle portion and said pivoted piece, said threaded member engaging mating threads in a rotatable member carried in said piece, said threaded member operable to pivot said piece about said handle portion as said threaded member is advanced or retracted within said rotatable member thereby altering the elevation of said light emitting device with respect to the barrel of the firearm; and a cam carried in said adapter body portion having an offset protuberance that engages a slot formed in said pivoted piece, said cam operable to pivot said adapter body portion with respect to said handle portion as said cam is rotated, thereby altering the horizontal disposition of the light emitting device with respect to the barrel of the firearm.

6. The apparatus of claim 1 wherein said trigger mechanism comprises:

a finger grip pivotally mounted on said adapter; and an actuator member carried in said adapter for reciprocating movement with resilient means biasing said actuator member against said finger grip;

said actuator member being moved against the resistance of said resilient means through camming action which occurs as said finger grip is pivoted.

7. The apparatus of claim 6 wherein the switch mechanism on said shockproof mount comprises:

an elongate bar mounted to said shockproof mounted for limited pivotal movement, and a spring loaded push rod bearing against said elongate bar at one end and operable from the other end to close contacts on a switch that is in the electrical circuit path that supplies current to said light emitting device;

and wherein the actuator member of said trigger mechanism bears against said elongate bar when said shockproof mount is attached to said adapter such that, upon movement of said finger grip, said actuator member moves said bar thereby effecting opening or closing of the switch.

8. The apparatus of claim 1 wherein said shockproof mount comprises:

a body portion having means for attaching said light emitting device; and a pneumatic buffer carried in said body portion having said mounting arm attached thereto;

said buffer being operable to absorb recoil energy of the firearm and cushion said light emitting device from shock upon recoil.

9. The apparatus of claim 8 wherein said buffer comprises:

a cylinder having an orifice at each end;

a piston having said mounting arm secured thereto, said piston being disposed in said cylinder for longitudinal movement therein;

first and second resilient means disposed within said cylinder on opposite sides of said piston, with the opposite ends of each disposed in engagement with an end of said cylinder and an end of said piston.

* * * * *

UNITED STATES PATENT OFFICE

CERTIFICATE OF CORRECTION

Patent No. 4,079,534 Dated March 21, 1978

Inventor(s) Wesley L. Snyder

It is certified that error appears in the above-identified patent and that said Letters Patent are hereby corrected as shown below:

Column 1, line 62, change "in" to --is--;

Column 6, line 52, change "36" to --37--;

Column 6, line 54, change "38" to --39--;

Column 12, line 15, should read --an elongate bar mounted to said shockproof mount-- instead of "an elongate bar mounted to said shockproof mounted".

Signed and Sealed this

Nineteenth Day of September 1978

[SEAL]

*Attest:*

RUTH C. MASON
*Attesting Officer*

DONALD W. BANNER
*Commissioner of Patents and Trademarks*